US008366383B2

(12) United States Patent
Thibodeau et al.

(10) Patent No.: US 8,366,383 B2
(45) Date of Patent: Feb. 5, 2013

(54) AIR SEALING ELEMENT

(75) Inventors: Anne-Marie B. Thibodeau, Sanford, ME (US); Susan M. Tholen, Kennebunk, ME (US)

(73) Assignee: United Technologies Corporation, Hartford, CT (US)

( * ) Notice: Subject to any disclaimer, the term of this patent is extended or adjusted under 35 U.S.C. 154(b) by 1733 days.

(21) Appl. No.: 11/939,006

(22) Filed: Nov. 13, 2007

(65) Prior Publication Data

US 2009/0123266 A1 May 14, 2009

(51) Int. Cl.
*F04D 29/44* (2006.01)

(52) U.S. Cl. ..... 415/116; 415/173.1

(58) Field of Classification Search ..... 415/173.1, 415/115, 116

See application file for complete search history.

(56) References Cited

U.S. PATENT DOCUMENTS

| | | | | |
|---|---|---|---|---|
| 4,073,609 | A | 2/1978 | Petrenchik | |
| 4,489,469 | A | 12/1984 | Hall | |
| 5,052,889 | A * | 10/1991 | Abdel-Messeh | 416/97 R |
| 5,069,265 | A | 12/1991 | Blazek | |
| 5,243,759 | A | 9/1993 | Brown et al. | |
| 5,431,537 | A | 7/1995 | Sturm | |
| 5,465,780 | A | 11/1995 | Muntner et al. | |
| 5,486,090 | A | 1/1996 | Thompson | |
| 5,538,393 | A * | 7/1996 | Thompson et al. | 415/115 |
| 5,820,774 | A | 10/1998 | Dietrich | |
| 5,950,705 | A | 9/1999 | Huang | |
| 5,951,256 | A | 9/1999 | Dietrich | |
| 6,068,806 | A | 5/2000 | Dietrich | |
| 6,331,098 | B1 * | 12/2001 | Lee | 416/97 R |
| 6,739,381 | B2 | 5/2004 | Esser et al. | |
| 2006/0140753 | A1 * | 6/2006 | Romanov et al. | 415/173.1 |
| 2007/0237647 | A1 | 10/2007 | Bulgrin | |
| 2008/0005903 | A1 * | 1/2008 | Trindade et al. | 29/889.2 |

FOREIGN PATENT DOCUMENTS

| | | |
|---|---|---|
| JP | 60174242 | 9/1985 |
| JP | 62286657 | 12/1987 |

* cited by examiner

*Primary Examiner* — Christopher Verdier
*Assistant Examiner* — Aaron R Eastman
(74) *Attorney, Agent, or Firm* — Carlson, Gaskey & Olds PC

(57) ABSTRACT

A turbine blade outer air seal segment assembly has a first turbine blade outer air seal segment with a first end portion, a middle portion and a second end portion. The first turbine blade outer air seal segment is for connection with a second turbine blade outer air seal segment to form at least a part of a shroud of a turbine rotor. A first cooling passage is disposed within the first turbine blade outer air seal segment. The cooling passage extends from the first end portion to the second end portion and a land is disposed in at least one of the first or second end portions. The land represents a portion for receiving a mold ejection pin for a core forming the cooling passage.

22 Claims, 3 Drawing Sheets

AIR SEALING ELEMENT

BACKGROUND OF THE INVENTION

This invention relates to a turbine engine segment, such as a turbine blade outer seal.

A turbine blade outer air seal (BOAS) seals radial leakage around blade tips in the gas path of a turbine engine. Typically, the seal is made in circumferential panels or segments that are hooked to the engine case. These segments form a circular seal around the gas path. Due to the high temperature of the gases coming from the combustor of the turbine engine, BOAS segments are provided with cooling passages through which cooling air flow is passed often in a circumferential direction.

To form the cooling passages in the BOAS segment castings, ceramic cores are used. The BOAS segment is cast around the ceramic core and the core is then leached out leaving behind a cooling passage within the BOAS segment. These cores are also provided with turbulators, known as trip strips, that create ripples within the cooling passages so as to promote turbulent airflow through the passage, which improves the heat transfer rate and its cooling performance.

The ceramic cores themselves are formed in a separate die by injecting a ceramic slurry therein. The cores remain in the die for some time, until they have developed enough strength to be removed. To eject the cores from the dies without breakage, the cores are designed with a land to receive an ejection pin. When the ceramic cores are then used to create the cooling passages within the BOAS segment casting, these lands are then reproduced as part of the cooling passage. However, these lands preclude the formation of trip strips at their location. In the past, these lands have been located in the middle portion of the BOAS segment. Due to the absence of trip strips at the location of the land in the middle of the BOAS segment, the BOAS segment becomes susceptible to thermal mechanical fatigue (TMF). TMF may lead to cracking, which reduces the life of the part and is not desirable.

A need therefore exists for an improved design for the BOAS segment that eliminates or reduces the prospect of cracks caused by thermal mechanical failure.

SUMMARY OF THE INVENTION

The invention is a turbine engine segment assembly. The assembly has a first BOAS segment with a first end portion, a middle portion and a second end portion. The first BOAS segment is adjacent to a second BOAS segment to form at least a part of a shroud of a turbine rotor. A first cooling passage is disposed within the first turbine engine segment. The first cooling passage extends from the first end portion to the second end portion. A land is disposed within the first cooling passage. The land represents a portion for receiving a mold ejection pin for a core forming the cooling passage. The land is disposed at one of the first end portion and the second end portion of the BOAS segment.

The various features and advantages of this invention will become apparent to those skilled in the art from the following detailed description. The drawings that accompany the detailed description can be briefly described as follows.

DETAILED DESCRIPTION OF THE PREFERRED EMBODIMENT

Figure 1:
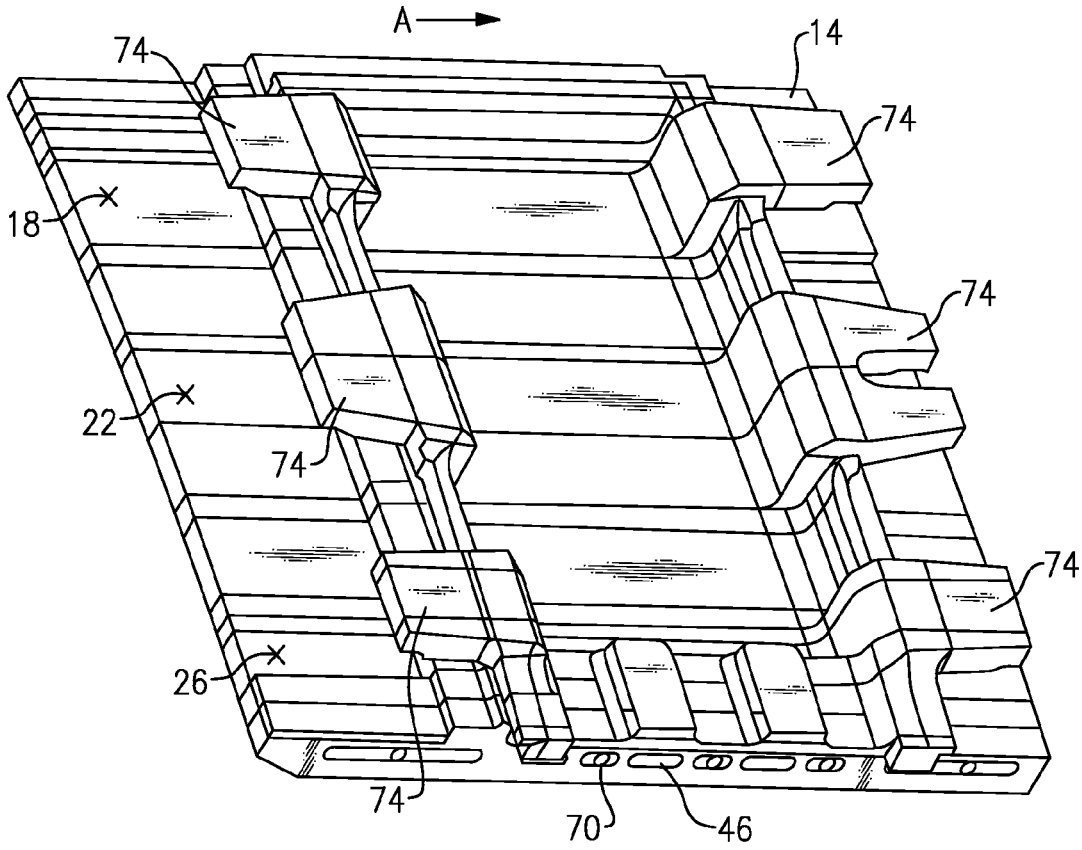
FIG. 1 illustrates a perspective view of a BOAS segment assembly, with first end portion, middle portion and second end portion.
Figure 2:
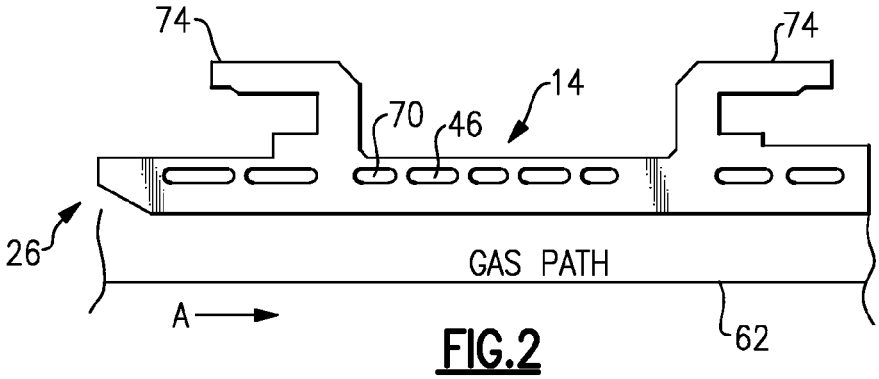
FIG. 2 illustrates a cross-sectional view of the BOAS segment assembly of FIG. 1 in relation to a gas flow path for a turbine engine.
Figure 3:
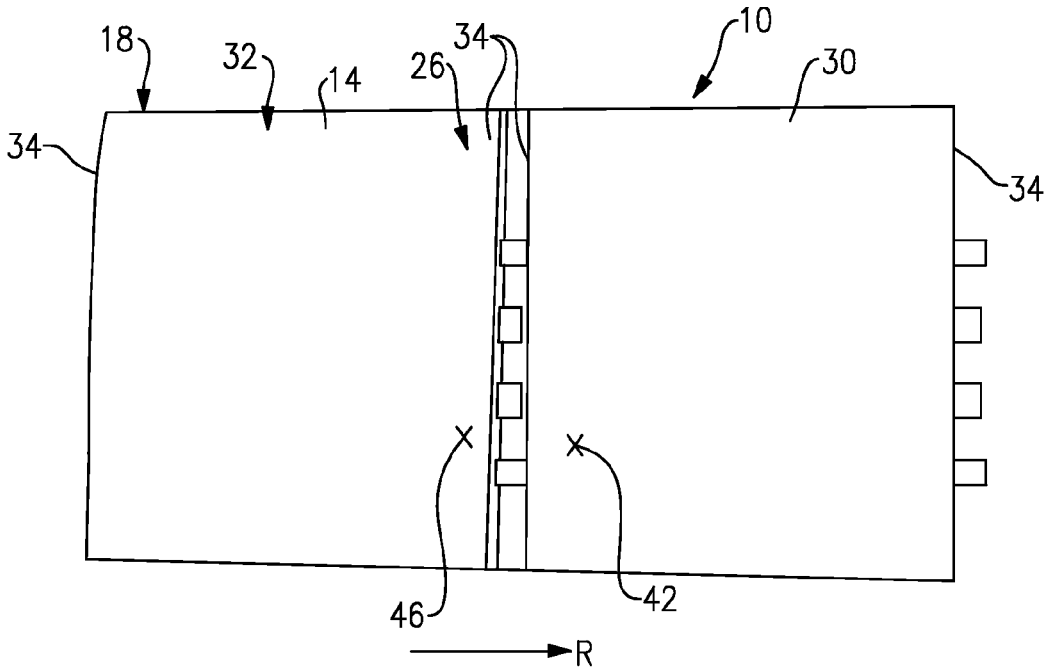
FIG. 3 illustrates a first BOAS segment and a second BOAS segment.

With reference to FIG. 1 to FIG. 3, there are shown first BOAS segment 14 and second BOAS segment 30. First BOAS segment 14, second BOAS segment 30 as well as other segments form a turbine blade outer air seal, which forms a circular segmented ring around the turbine blade that restricts leakage of turbine gas from the turbine engine gas flow path around the blade tip. Referring specifically to FIG. 1, an exemplary segment such as first BOAS segment 14 is shown. First BOAS segment 14 has first end portion 18, middle portion 22 and second end portion 26. Extending from first end portion 18 through middle portion 22 and second end portion 26 are first cooling passages 46 and second cooling passage 70. BOAS segments 14 and 13 interface with, but do not communicate with, each other.

Second BOAS segment 30 has adjoining edge 34, which serves as an interface with first BOAS segment 14. The connection between first BOAS segment 14 and second BOAS segment 30 comprises a small gap to allow for thermal growth between the segments. Cooling flow through each BOAS segment exits the segment and combines with the gas path.

FIG. 2 illustrates a cross-sectional view of first BOAS segment 14. As shown, first BOAS segment 14 has hooks 74 that allow BOAS segment 14 to be received into a case of a turbine engine. In addition, when BOAS segment 14 is disposed within the turbine engine case, it is located proximate gas path 62 for the turbine engine. Axial flow from the turbine engine through the gas path 62 is in the direction of arrow A. With reference to FIG. 3, the turbine blades for the turbine engine rotate in the direction of arrow R as shown in FIG. 3.

Figure 4:
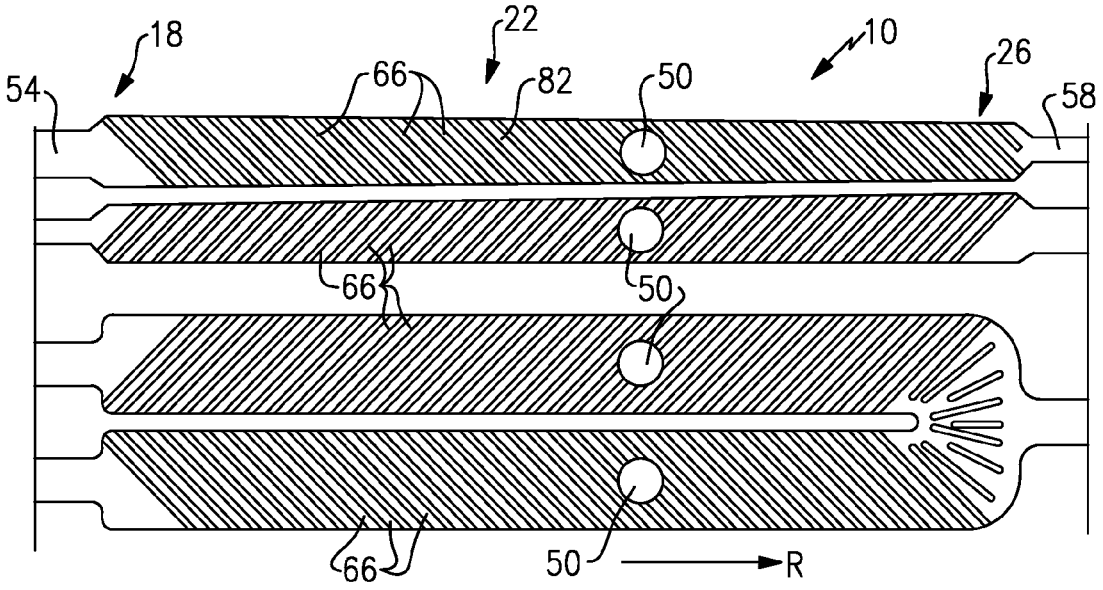
FIG.4 Prior Art
FIG. 4 illustrates a prior design for a cooling passage of a BOAS segment.

FIG. 4 illustrates a plan exposed view of a prior design of a cooling passage, here cooling passage 82. As shown, cooling passage 82 has first opening 54 on cooling air supply side of BOAS segment and second opening 58 at intersegment edge of BOAS segment. Cooling passage 82 extends from first opening 54 to second opening 58 through first end portion 18, middle portion 22 and to second end portion 26. Disposed within cooling passage 82 are turbulating features 66 for causing turbulent fluid flow through cooling passage 82. These features are commonly known as trip strips. Moreover, land 50 is disposed in middle portion 22 of BOAS segment 14 within cooling passage 82. Land 50 is representative of a portion for receiving a mold ejection pin for a core forming the cooling passage, here cooling passage 82. As shown, there are no features 66 for causing fluid flow turbulence at the location of ejector pin land 50. The features 66 help the cooling air remove heat from the BOAS by generating turbulence in the air as well as by increasing the surface area for heat transfer.

Figure 5:
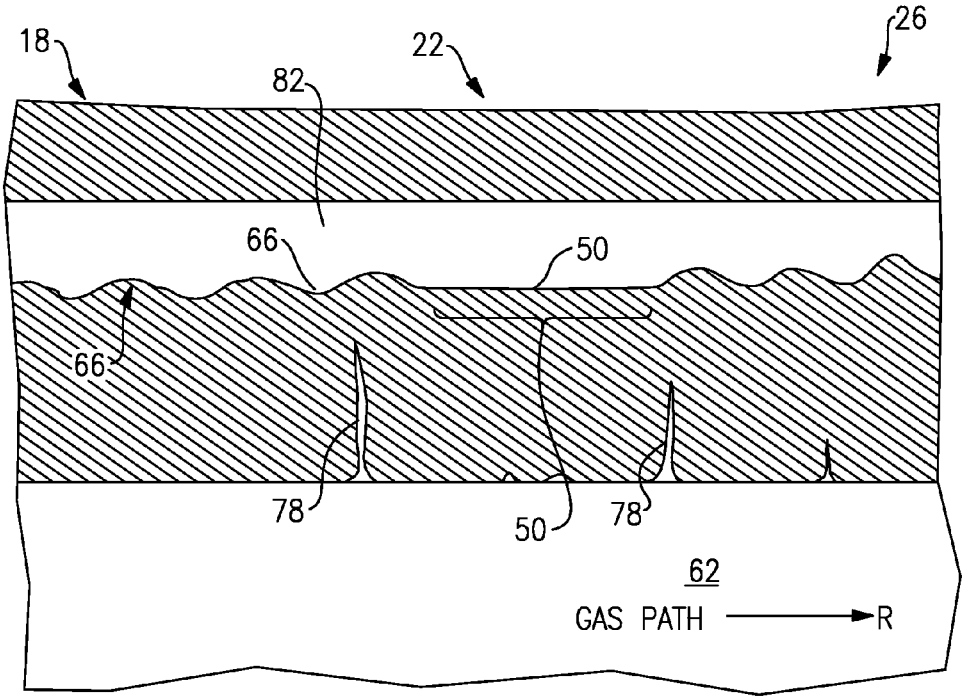
FIG.5 Prior Art
FIG. 5 illustrates a cross-sectional view of the cooling passage of FIG. 4, illustrating thermal mechanical fatigue cracks which were possibly created or exacerbated by the land region.

Consequently, with reference to FIG. 5, there is an interruption of features 66 which aid in removing heat from the BOAS. The temperatures within gas path 62 are very high in comparison to cooling flow through cooling passage 82, so heat tends to build up at the land 50 locations, which causes a thermal gradient in the region. Coupled with other thermal gradients in the part and the curling/uncurling that takes place in the BOAS segment with the cycling engine temperatures, this thermal gradient exacerbates thermal mechanical fatigue which tends to occur most frequently near the middle of the part panel between hook attachment features.

Figure 6:
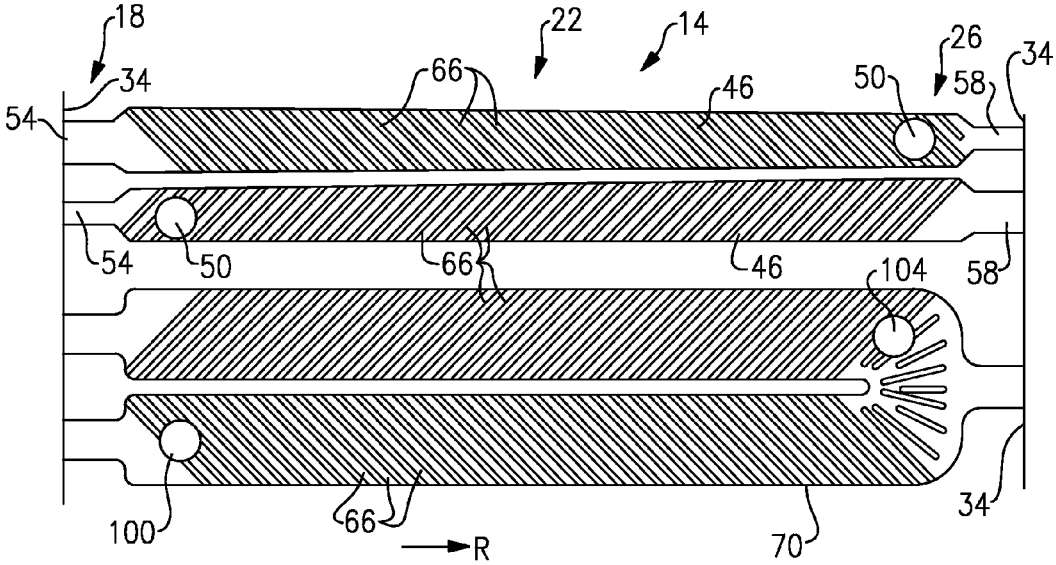
FIG. 6 illustrates an inventive BOAS segment with push-pin land relocated.

To minimize the effect of the land 50 and features 66, with reference to FIG. 6, the locations of land 50 are moved such that they are no longer located in middle portion 22 of first BOAS segment 14. Instead, the lands 50 are disposed in first end portion 18 or second end portion 26. They may be accordingly located near one of first opening 54 or second opening 58. In addition, with reference to second cooling passage 70, first land 100 is disposed in first end portion 18 while second land 104 is disposed in second end portion 26. Because the cooling flow through first cooling passage 46 is cooler at edges 34 near openings, such as first opening 54, and 'curling/uncurling' of the BOAS segment has less effect on the edges of the BOAS, the absence of trip strips in these areas is less significant. Consequently, turbine engine segment 14 will be less susceptible to thermal mechanical fatigue (TMF) and will have longer life.

The foregoing description shall be interpreted as illustrative and not in any limiting sense. A worker of ordinary skill in the art would recognize that certain modifications would come within the scope of this invention. For that reason, the following claims should be studied to determine the true scope and content of this invention.

We claim:

1. A turbine engine gas path sealing segment, comprising:

a first turbine blade outer air seal segment having a first end portion, a middle portion and a second end portion, said first turbine blade outer air seal segment configured for connection with a second turbine blade outer air seal segment to form at least a part of a shroud of a turbine rotor;

a first cooling passage disposed in said first turbine blade outer air seal segment, said first cooling passage extending from said first end portion to said second end portion; and a land in said first cooling passage, said land representative of a portion for receiving a mold ejection pin for a core forming said first cooling passage, wherein said land is disposed at one of said first end portion and said second end portion; and a turbulating feature in said first cooling passage for causing fluid flow turbulence in said first cooling passage.

2. The turbine blade outer air seal segment assembly of claim 1 wherein said first cooling passage has a first opening at said first end portion and a second opening at said second end portion, said land disposed proximate one of said first opening and said second opening.

3. The turbine blade outer air seal segment assembly of claim 2 wherein cooling flow exits said second opening to a gas path for the turbine engine.

4. The turbine blade outer air seal segment assembly of claim 1 wherein said feature comprises a series of trip strips.

5. The turbine blade outer air seal segment assembly of claim 1 wherein said feature is disposed proximate said land.

6. The turbine blade outer air seal segment assembly of claim 5 wherein said feature extends across said middle portion of said turbine blade outer air seal segment.

7. The turbine blade outer air seal segment assembly of claim 1, wherein said lands interrupt said turbulating feature.

8. The turbine blade outer air seal segment assembly of claim 1 wherein said first cooling passage may extends along a direction of rotation of a rotor for the turbine engine.

9. The turbine blade outer air seal segment assembly of claim 1 including a second turbine blade outer air seal segment, said second turbine blade outer air seal segment having an edge for interfacing with said first turbine blade outer air seal segment.

10. The turbine blade outer air seal segment assembly of claim 9 wherein said land is located proximate said edge of said second turbine blade outer air seal segment.

11. A turbine blade outer air seal segment assembly, comprising:

a first turbine blade outer air seal segment having a first end portion, a middle portion and a second end portion, said first turbine blade outer air seal segment for connection with a second turbine blade outer air seal segment to form at least a part of a shroud of a turbine rotor;

a first cooling passage disposed in said first turbine blade outer air seal segment, said first cooling passage extending from said first end portion to said second end portion and having a first opening at said first end portion and a second opening at said second end portion;

a land in said first cooling passage disposed proximate one of said first opening and said second opening, said land representative of a portion for receiving a mold ejection pin for a core forming said first cooling passage, said land disposed at one of said first end portion and said second end portion; and a series of trip strips in said first cooling passage for causing fluid flow turbulence in said first cooling passage wherein said series of trip strips is disposed proximate said land.

12. The turbine blade outer air seal segment assembly of claim 11 wherein said series of trip strips extends across said middle portion of said turbine blade outer air seal segment.

13. The turbine blade outer air seal segment assembly of claim 11 including a second turbine blade outer air seal segment, said second turbine blade outer air seal segment having an edge for interfacing with said first turbine blade outer air seal segment.

14. The turbine blade outer air seal assembly of claim 13 wherein said land is located proximate said edge of said second turbine blade outer air seal assembly.

15. The turbine blade outer air seal segment assembly of claim 11 wherein said first turbine blade outer air seal segment forms part of a turbine blade outer air seal for the turbine engine.

16. The turbine blade outer air seal segment assembly of claim 11 wherein including a second cooling passage, said second cooling passage extending from said first end portion to said second end portion, said second cooling passage having another land, wherein said land is located at said first end portion and said another land is located at said second end portion.

17. The turbine blade outer air seal segment assembly of claim 11, wherein said lands interrupt said series of trip strips.

18. A method of manufacturing a turbine blade outer air seal segment, the method comprising the steps of:

a) forming a cooling passage across a first end portion, a middle portion and a second end portion of a turbine blade outer air seal segment;

b) disposing a land in the cooling passage, the land representative of a portion for receiving a mold ejection pin for a core forming the cooling passage;

c) locating the land at one of the first end portion and the second end portion; and d) disposing trip strips for creating turbulent fluid flow in the cooling passage across the middle portion.

19. The method of claim 18 wherein the land representative of the portion for receiving a mold ejection pin for a core forming the cooling passage comprises a first land and a second land.

20. The method of claim 19 wherein the first land is located in the first end portion and the second land is located in the second end portion.

21. The method of claim 18 including the step of disposing the cooling passage proximate to a gas path.

22. The method of claim 18, wherein the step of disposing trip strips for creating turbulent fluid flow in the cooling passage across the middle portion further comprises disposing trip strips across said first end section or said second end section such that said land interrupts said trip strips.

* * * * *